United States Patent [19]

Feigenbaum et al.

[11] Patent Number: 4,916,755

[45] Date of Patent: Apr. 17, 1990

[54] SWIMSUIT

[75] Inventors: Jay Feigenbaum, Hamden; Janna Parris, Branford, both of Conn.

[73] Assignee: Robby Len Fashions, Inc., New Haven, Conn.

[21] Appl. No.: 259,973

[22] Filed: Oct. 19, 1988

[51] Int. Cl.[4] ..... A41D 7/00

[52] U.S. Cl. ..... 2/67; 450/115; 450/40

[58] Field of Search ..... 2/67; 450/39, 40, 115

[56] References Cited

U.S. PATENT DOCUMENTS

| | | | |
|---|---|---|---|
| 1,277,074 | 8/1918 | Hitzeman | 2/78 C |
| 2,033,456 | 3/1936 | Cunningham | 2/67 |
| 2,100,163 | 11/1937 | Goodman | 450/115 |
| 2,196,492 | 4/1946 | Clark et al. | 450/115 |
| 2,774,073 | 12/1956 | Herbener | 450/115 X |
| 3,182,664 | 5/1965 | Bradd | 450/115 |
| 3,225,768 | 12/1965 | Galitzki et al. | 450/39 |
| 3,327,707 | 6/1967 | Storti | 450/115 |
| 3,375,829 | 4/1968 | Brennan et al. | 450/115 |
| 3,392,730 | 7/1968 | Relli | 2/243 R |
| 3,489,154 | 1/1970 | Kaspar et al. | 450/115 X |
| 3,683,419 | 8/1972 | Lewis | 2/69 X |
| 3,712,378 | 1/1973 | Herbener | 2/67 |
| 3,771,172 | 11/1973 | Barg | 2/67 |
| 3,777,764 | 12/1973 | Herbener | 2/67 |
| 3,932,896 | 1/1976 | Dottinger | 2/67 |
| 4,095,291 | 6/1978 | Di Tullio | 2/67 |
| 4,343,044 | 8/1982 | Borda et al. | 2/67 |
| 4,398,538 | 8/1983 | Johnson | 2/67 X |
| 4,494,546 | 1/1985 | Steinman | 2/67 X |
| 4,557,267 | 12/1985 | Cole | 450/40 |
| 4,571,742 | 2/1986 | Wior | 2/67 |
| 4,654,894 | 4/1987 | Kudo | 2/67 |
| 4,698,947 | 10/1987 | Yoshihara | 2/67 |
| 4,701,964 | 10/1987 | Bell et al. | |

OTHER PUBLICATIONS

Sears 1988 Spring/Summer Catalog, pp. 287–298.

*Primary Examiner*—Werner H. Schroeder
*Assistant Examiner*—Jeanette E. Chapman
*Attorney, Agent, or Firm*—DeLio & Associates

[57] ABSTRACT

A swimsuit having an inner liner of stretchable and resilient fabric for encasing at least a portion of a person's torso, including the abdomen, hips and rear areas; at least one control panel bonded to the inner liner for restricting the stretching of the inner liner fabric and controlling bulging at a desired area of the encased torso; and an outer swimsuit fabric covering over the inner liner. The control panels are preferably located on the abdomen and both upper rear hip areas of the inner liner and have significantly less stretch than the inner liner fabric alone. The panels may be made of soft, flexible synthetic fabric or plastic laminated to either the interior or exterior surface of the inner liner.

33 Claims, 2 Drawing Sheets

FIG. 1
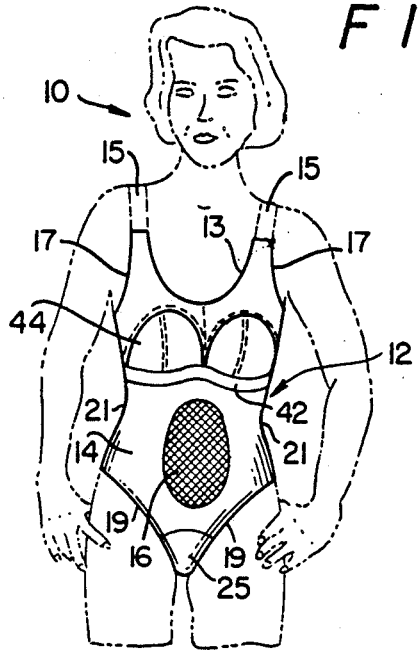
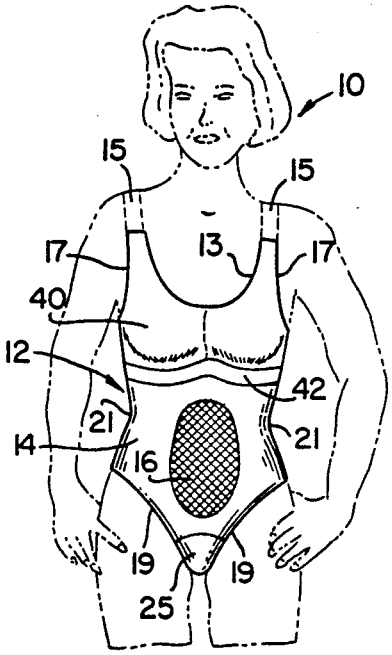
FIG. 2
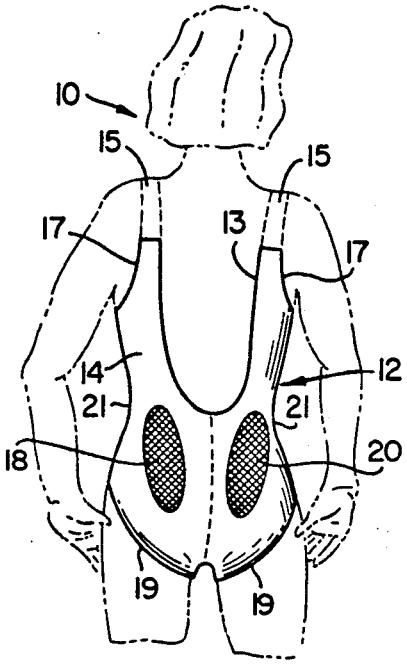
FIG. 3

SWIMSUIT

BACKGROUND OF THE INVENTION

This invention relates to an improved swimsuit and, in particular, to an improved women's swimsuit which shapes and improves the figure of the person wearing it.

Various prior art women's swimsuit designs utilize figure-shaping means within the construction of the swimsuit. U.S. Pat. No. 3,771,172 discloses a swimsuit that utilizes an inner elastic garment and a reinforcing panel sewn along its edges to the inner garment and made of the same material. U.S. Pat. No. 4,698,847 discloses a swimsuit which uses stretchable cloth members to support and firm various portions of the body while U.S. Pat. Nos. 3,712,308 and 3,777,764 disclose an elastic undergarment which utilizes a moveable stay unit in the abdomen region. Also, U.S. Pat. No. 4,571,742 discloses a swimsuit utilizing an inner garment which includes arcuate stays which flattens out abdominal bulge. Although these swimsuits provide some limited shaping effect, they do not produce the overall aesthetic appearance of an "hourglass-like" shape. In addition, they provide difficulties in manufacturing and/or can be uncomfortable to wear.

With the problems and deficiencies of the prior art in mind, it is therefore an object of the present invention to provide an improved women's swimsuit which shapes the figure of the wearer to an aesthetically pleasing hourglass-like shape.

It is a further object of the present invention to provide a swimsuit which restricts the bulging of the wearer's figure in the abdomen and hip regions.

It is another object of the present invention to provide a swimsuit which is comfortable to the wearer and is easily manufactured.

It is yet another object of the present invention to provide a reinforced swimsuit which permits a full range of activities while being resistant to environmental effects in normal swimsuit use.

SUMMARY OF THE INVENTION

The above and other objects, which will be apparent to one skilled in the art, are achieved in the present invention which provides a swimsuit having an inner liner of stretchable and resilient fabric for encasing at least a portion of a person's torso, including the abdomen, hips and rear areas; at least one control panel bonded to the inner liner for restricting the stretching of the inner liner fabric and controlling bulging at a desired area of the encased torso; and an outer swimsuit fabric covering over the inner liner.

The control panels are preferably located on the abdomen and both upper rear hip areas of the inner liner and have less than 50% of the stretch of the inner liner fabric alone. The panels may be made of soft, flexible synthetic fabric or plastic laminated to either the interior or exterior surface of the inner liner.

BRIEF DESCRIPTION OF THE DRAWINGS

FIG. 1 is a front view of a first embodiment of the bra and inner liner portion of the swimsuit of present invention as worn on a female figure.

FIG. 2 is a front view of another embodiment of the bra and inner liner portion of the present invention as worn on a female figure.

FIG. 3 is a rear view of the inner liner portion of FIGS. 1 and/or 2.

DETAILED DESCRIPTION OF THE INVENTION

Figure 5:
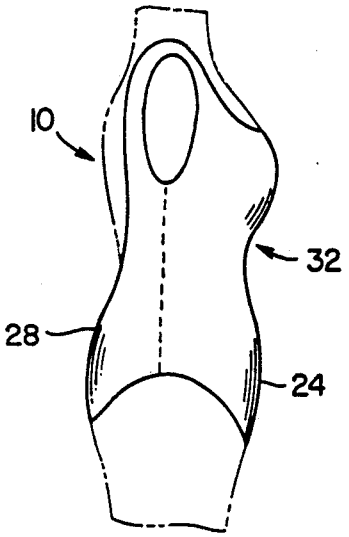
FIG. 5 is a side view of an outer swimsuit garment worn without the figure-controlling inner liner of the present invention.

The preferred embodiments of the present invention are described with reference to FIGS. 1 through 6 in which like numerals refer to like features of the invention.

FIGS. 1 through 3 illustrate the preferred inner liner portion of the swimsuit of the present invention as worn on a female form 10. FIGS. 1 and 2 depict the front view of alternate embodiments of the inner liner, and FIG. 3 depicts the rear view of both of the embodiments of FIGS. 1 and 2. The inner liner 12 encases the lower portion of the torso of the female form and is made of a soft, stretchable, resiliant synthetic or synthetic blend fabric such as spandex, nylon, polyester, and blends thereof. The elastic body-controlling liner 12 covers the body regions conventionally covered by a woman's one piece swimsuit (with the exception of the bust), including the abdomen, hip and rear areas of the body. In the front, the inner liner extends up to the lower edge of elastic strip 42 below the bra. In the rear, the inner liner extends partially up swimsuit shoulder straps 15 between liner armholes 17 and neckhole 13, which neckhole extends downward to approximately the waist to expose the back. Legholes 19 form openings in the lower portion of the inner liner which covers the conventional areas of the abdomen, crotch, and buttocks. Optionally, a fabric insert 25, made of a soft, stretch material such as 100% nylon, may be substituted for the inner liner in the crotch area for the comfort of the wearer.

The liner fabric 14 is generally oriented so that the warp direction (parallel to the selvage edge of the fabric) is arranged in approximately the horizontal direction to wrap around the torso whereas the fill direction (perpendicular to the selvage edge of the fabric) is oriented vertically. The liner fabrics disclosed above typically have a greater degree of stretch in the warp direction and a lesser degree of stretch in the fill direction.

In the embodiment shown in FIG. 1, the liner 12 includes a cup-type bra 44 which is secured along its lower edge by a strip of elastic 42 to the lower portion of the inner liner. The cups of the bra portion 44 are made of foam covered by fabric (either cut-and-sewn or molded) to give good support while also adding size to the bust. In the second embodiment shown in FIG. 2, a soft fabric bra 40 that gives minimal support and a more natural look to the bust is substituted. The natural bra 40 may be made of any conventional bra fabric such as 100% nylon. Both bra portions 40 and 44 extend partially up the strap regions 15 (shown in phantom) of the outer swimsuit on either side of neckhole 13.

To restrict the stretching of the liner fabric 14 and shape the body of the wearer 10 to provide a more appealing appearance, there are provided a plurality of soft, flexible control panels of limited size bonded to selected, separate discrete areas of the inner liner 12. A first control panel 16 of approximately oval shape is located on the stomach or central abdomen region of liner 12, below the bra portion (FIGS. 1 and 2). On the rear of the inner liner 12, a pair of elongated oval control patches 18 and 20 are located symmetrically on the upper rear hip areas. The abdomen control panel 16 flattens any bulge in that region and makes it appear as though the muscles in the are are firmer and toned. The control panels 18, 20 on the back upper hips shape the hips and narrow the waist so that the buttocks are not flattened, but are instead firmed and rounded into a more appealing appearance.

The control panels 16, 18 & 20 are preferably made from a flexible, soft material, different from the inner liner fabric 14, which provides considerably less stretch in both the warp and fill directions. The control panels may be made of a plastic film or synthetic fabric material and should be bonded along the entire surface contacting the inner liner fabric 14. The bonding is preferably by lamination, i.e., by applying heat and pressure to the control panel and inner liner fabric in an amount sufficient to fuse the two together. The specific temperatures and pressures vary with the type of lamination equipment utilized and can be determined by simple and routine experimentation. The inner liner and control panel materials should be selected to be compatible when laminated together, i.e., the lamination should be such that the panel and inner liner are bonded together to prevent delamination during the expected use and life of the swimsuit, without damaging or otherwise affecting the performance of either panels or inner liner. During lamination, a textured pattern may be applied to a plastic film control panel to give it the look and feel of fabric.

Figure 4A:
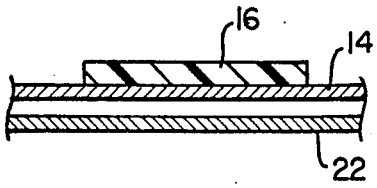
FIGS. 4*a* and 4*b* are alternate cross-sectional views of a portion of the present invention showing the outer swimsuit, the inner liner and the bonded control panel.
Figure 4B:
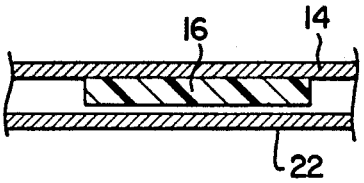

In FIGS. 4*a* and 4*b* there are shown cross sectional views through the swimsuit of the present invention in the regions of a typical control panel, here shown as abdomen panel 16. In FIG. 4*a*, there is shown the configuration wherein control panel 16 is on the inside surface of inner liner fabric 14 and, thus, would directly contact the body of the wearer 10. In FIG. 4*b*, there is shown an alternate configuration (also depicted in FIGS. 1 through 3) wherein the control panel 16 is bonded to the exterior of the inner liner fabric 14 and, thus, would not contact the body of the wearer 10. In both configurations shown in FIGS. 4*a* and 4*b*, an outer swimsuit covering of fabric 22 loosely overlies both the inner liner and the control panels. It is preferred that all of the control panels are bonded to the exterior of the inner liner fabric in order to prevent any possible discomfort due to the selection of the control panel material. However, where it becomes necessary to hide the control panel more fully, for example, when using thin outer fabrics 22, then it is acceptable to place one or more of the control panels on the inside surface of the fabric liner, as long as the control panel materials are selected to avoid any discomfort or irritation to the skin of the wearer.

The control panel material should be selected to have sufficient thickness and other properties to significantly reduce the degree of stretch of the inner liner fabric bonded thereto. It is preferred that the degree of stretch of the control panel-bonded inner fabric be reduced by an amount of 50% or more, compared to the inner liner fabric alone, depending on the stretching test employed. The control panel thickness should also be minimized, preferably about 5 mils (0.005 in.) or less so that the outline of the panel is not visible from the exterior of the swimsuit.

In stretch tests performed under the standard AATCC (American Association of Textile Chemists and Colorists) test no. IP-4 using a Scott measuring machine with the equivalent of 30 lb weight, 3 cycles, the following results were obtained:

TABLE 1

| Stretch Measurement - AATCC IP-4 | Warp direction | Fill direction |
|---|---|---|
| inner liner fabric[1] alone | 220% | 140% |
| inner liner fabric[1] bonded to control panel[2] | 30% | 20% |

note:
[1]Darlington No. 2225 spandex.
[2]Liebe Group plastic film (80% urethane, 20% polyester) of 5 mil thickness.

In each case, the bonded control panel/inner liner fabric had a stretch of only about 14% of the original inner liner fabric alone. When using this AATCC test method to determine relative stretch, it is preferred that the bonded control panel/inner liner fabric have a stretch of less than 50%, and more preferably less than 25%, compared to the inner liner fabric alone.

Another common method of testing stretch in fabrics utilizes a Fryma dual extensiometer, using either 2.75 lb or 4.44 lb weights. This test equipment and method is described in British Patent No. 953215, the disclosure of which is hereby incorporated by reference. Under the Fryma test, the following results were obtained:

TABLE 2

| Stretch Measurement - Fryma (2.75 lb) | Warp direction | Fill direction |
|---|---|---|
| inner liner fabric[1] alone | 60 | 28 |
| inner liner fabric[1] bonded to control panel[2] | 2 | 0 |
| **Stretch Measurement - Fryma (4.44 lb)** | | |
| inner liner fabric[1] alone | 108 | 40 |
| inner liner fabric[1] bonded to control panel[2] | 4 | 0 |

notes:
[1]spandex
[2]80% polyurethane/20% polyester

Utilizing this Fryma test method, it is preferred that the stretch of the control panel bonded to the inner liner fabric be less than 20%, and preferably less than 10%, of the stretch measurement of the inner liner fabric alone. The panels bonded to the liner fabric as tested by this method restricted stretch from 95 to 97% in the warp direction and 100% in the fill direction. Tests made using the Fryma method on a bonded control panel made of 80% polyurethane/20% polyether resulted in a stretch of 20% of the stretch of the inner fabric and, in practice, this control panel material did not give as good stretch restriction as the aforementioned polyurethane/polyester film.

In addition to the above, the preferred control panel material of 80% polyurethane/20% polyester plastic bonded onto a stretch lining fabric of 85% Antron brand nylon/15% Lycra brand spandex gave good results when subjected to various tests methods established by the American Association of Textile Chemists and Colorists for exposure to chlorinated pool water, seawater, perspiration, and oven aging and colorfastness to light.

Figure 6:
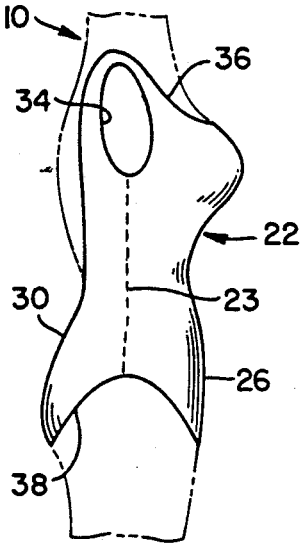
FIG. 6 is a side view of the swimsuit of the present invention with the figure-controlling inner liner.

To complete the swimsuit of the present invention, an outer swimsuit fabric covering extends over the entire inner lining, including the control panels. This outer swimsuit covering may be made of conventional outer swimsuit fabrics such as nylon, spandex, polyester or the like. The outer covering is fitted somewhat more loosely than the body-controlling inner liner to give the body an all-over thinner appearance. As shown in FIG. 6, the outer swimsuit covering 22 extends completely over and conceals the inner liner 12, including the bra portion. The outer swimsuit 22 is sewn and secured at neck opening 36, arm openings 34 and leg openings 38 to the corresponding neck, arm and leg openings respectively of the inner liner 12 and bra 40 or 42. Optionally, the outer swimsuit fabric 22 may be additionally sewn at its side seam 23 to secure it to the corresponding side seam 21 of the inner liner.

In FIG. 5 there is shown for comparison a swimsuit 32 which does not utilize the control panels bonded to the inner liner as described herein. In comparing the appearance of the swimsuits of FIGS. 5 and 6, the abdomen area 26 in the present invention is more shaped and slimmed than the abdomen area 24 in the uncontrolled swimsuit. Likewise, the hip areas 30 in the present invention (FIG. 6) provide a more controlled and shaped appearance than the unshaped hip area 28 (FIG. 5).

Thus, the present invention provides a swimsuit construction which effects a pleasing hourglass-like shaping to the body of the wearer while not interfering with the comfort and use of the swimsuit. In addition, the swimsuit is relatively easy to manufacture with readily available and low-cost materials and processes.

While this invention has been described with reference to specific embodiments, it will be recognized by those skilled in the art that variations are possible without departing from the spirit and scope of the invention, and that it is intended to cover all changes and modifications of the invention disclosed herein for the purposes of illustration which do not constitute departure from the spirit and scope of the invention.

Having described the invention, what is claimed is:

1. A swimsuit comprising:

a tightly fitting, body-controlling inner liner of stretchable, resilient synthetic or synthetic blend fabric selected from the group consisting of nylon, polyester, spandex, and blends thereof for encasing at least a portion of a person's torso, including the abdomen, hips and rear area, and having legholes in the liner lower portion;

a bra portion secured to said inner liner;

a plurality of control panels of soft, flexible synthetic fabric or plastic having less than 25% of the stretch of said inner liner fabric alone in both warp and fill directions laminated on the abdomen and upper rear hip areas of said inner liner by directly contacting the surfaces of the panels and liner and applying heat and pressure to fuse the panels and liner together for restricting the stretching of said inner liner fabric and controlling bulging at said areas to provide a more appealing shape to the torso; and an outer swimsuit fabric covering over said inner liner, including said bra portion, said outer swimsuit secured to said inner liner at said bra portion and said legholes.

2. The swimsuit of claim 1 wherein said control panels are laminated to the exterior surface of said inner liner.

3. The swimsuit of claim 1 wherein said control panels are laminated to the interior surface of said inner liner.

4. The swimsuit of claim 1 wherein the control panel material is selected from the group consisting of polyester, polyurethane and blends thereof.

5. The swimsuit of claim 4 wherein an elastic material is disposed between said bra and said inner liner.

6. The swimsuit of claim 1 wherein an elastic material is disposed between said bra and said inner liner.

7. A swimsuit comprising:

an inner liner of stretchable, body-controlling synthetic or synthetic blend resilient fabric for fitting tightly and encasing at least a portion of a person's torso, including the abdomen, hips and rear areas, and having legholes in the liner lower portion;

at least one flexible synthetic fabric or plastic control panel of significantly lower stretchability laminated to said inner liner for restricting the stretching of the liner fabric and controlling bulging at a desired area of the encased torso; and an outer swimsuit fabric covering over said inner liner, said outer swimsuit covering secured to said inner liner at said legholes.

8. The swimsuit of claim 7 wherein the inner liner fabric material is selected from the group consisting of nylon, polyester, spandex, and blends thereof, and the control panel material is selected from the group consisting of polyester, polyurethane and blends thereof, and wherein the lamination is by directly contacting the surfaces of the panel and liner materials and applying heat and pressure to fuse the panels and liner together.

9. The swimsuit of claim 8 wherein said control panel is bonded to the exterior surface of said inner liner.

10. The swimsuit of claim 8 wherein said control panel is bonded to the interior surface of said inner liner.

11. The swimsuit of claim 7 wherein the control panel-bonded inner liner fabric has less than 25% of the stretch of said inner liner fabric alone in both warp and fill directions.

12. The swimsuit of claim 11 including a control panel located on the abdomen area of said inner liner.

13. The swimsuit of claim 12 including a pair of control panels located on the upper rear hip areas of said liner to shape the hips without flattening the buttocks.

14. The swimsuit of claim 12 wherein the inner liner fabric material is selected from the group consisting of nylon, polyester, spandex and blends thereof and wherein the control panel material is selected from the group consisting of polyester, polyurethane and blends thereof.

15. The swimsuit of claim 14 further including a bra portion secured to said inner liner.

16. The swimsuit of claim 15 wherein an elastic material is disposed between said bra and said inner liner.

17. The swimsuit of claim 15 wherein said outer swimsuit covering and said inner liner include corresponding side seams further securing said outer swimsuit covering and said liner.

18. The swimsuit of claim 15 wherein the control panels are laminated to the exterior surface of said inner liner.

19. The swimsuit of claim 15 wherein the control panels are laminated to the interior surface of said inner liner.

20. The swimsuit of claim 15 wherein said liner has openings for the neck and arms and wherein the outer swimsuit covering is further secured to the liner at the neck and arm openings.

21. A swimsuit comprising:

an inner liner of stretchable and resilient fabric for encasing at least a portion of a person's torso, including the abdomen, hips and rear areas, said liner having openings for the neck, arms and legs;

at least one control panel bonded to the exterior surface of said inner liner for restricting the stretching of the liner fabric and controlling bulging at a desired area of the encased torso; and an outer swimsuit fabric covering over said inner liner secured at the liner neck, arm and leg openings.

22. The swimsuit of claim 21 including a control panel located on the abdomen area of said inner liner.

23. The swimsuit of claim 21 including a pair of control panels located on the upper rear hip areas of said liner to shape the hips without flattening the buttocks.

24. The swimsuit of claim 21 wherein said inner liner fabric is an elastic, body-controlling synthetic or synthetic blend for fitting tightly against said torso and wherein said control panel is a flexible synthetic fabric or plastic panel of significantly lower stretchability laminated to said inner liner fabric by directly contacting the panel and liner and applying heat and pressure to fuse the panel and liner together.

25. The swimsuit of claim 24 wherein the control panel bonded to the inner liner fabric has less than 50% of the stretch of said inner liner fabric alone.

26. The swimsuit of claim 21 wherein the inner liner fabric material is selected from the group consisting of nylon, polyester, spandex, and blends thereof, and wherein the control panel material is selected from the group consisting of polyester, polyurethane and blends thereof.

27. The swimsuit of claim 26 further including a bra portion secured to said inner liner and an elastic material disposed between said bra and said liner.

28. The swimsuit of claim 21 including control panels located on the abdomen and upper rear hip areas of said liner.

29. The swimsuit of claim 28 wherein said outer swimsuit covering and said inner liner include corresponding side seams further securing said outer swimsuit covering and said liner.

30. The swimsuit of claim 26 wherein said outer swimsuit covering and said inner liner include corresponding side seams further securing said outer swimsuit covering and said liner.

31. The swimsuit of claim 30 further including a bra portion secured to the inner liner and an elastic strip disposed between the bra and liner.

32. The swimsuit of claim 31 wherein the control panels are bonded to the exterior surface of said inner liner.

33. The swimsuit of claim 31 wherein the control panels are bonded to the interior surface of said inner liner.

* * * * *